US010633989B2

(12) United States Patent
Jaiswal et al.

(10) Patent No.: US 10,633,989 B2
(45) Date of Patent: Apr. 28, 2020

(54) TURBOMACHINE AND TURBINE NOZZLE THEREFOR

(71) Applicant: General Electric Company, Schenectady, NY (US)

(72) Inventors: Shashwat Swami Jaiswal, Bangalore (IN); Rohit Chouhan, Bangalore (IN); Lukasz Szajko, Warsaw (PL)

(73) Assignee: General Electric Company, Schenectady, NY (US)

( * ) Notice: Subject to any disclaimer, the term of this patent is extended or adjusted under 35 U.S.C. 154(b) by 47 days.

(21) Appl. No.: 15/775,168

(22) PCT Filed: Dec. 18, 2015

(86) PCT No.: PCT/PL2015/050069
§ 371 (c)(1),
(2) Date: May 10, 2018

(87) PCT Pub. No.: WO2017/105259
PCT Pub. Date: Jun. 22, 2017

(65) Prior Publication Data

US 2018/0283190 A1 Oct. 4, 2018

(51) Int. Cl.
*F01D 9/04* (2006.01)
*F01D 5/14* (2006.01)

(52) U.S. Cl.
CPC ..... *F01D 9/041* (2013.01); *F01D 5/141* (2013.01); *F05D 2240/122* (2013.01); *F05D 2240/128* (2013.01); *F05D 2250/74* (2013.01)

(58) Field of Classification Search
CPC ..... F01D 9/041; F01D 5/141; F01D 5/145; F01D 5/16; F04D 29/38; F04D 29/384
See application file for complete search history.

(56) References Cited

U.S. PATENT DOCUMENTS 8,075,259 B2 * 12/2011 Praisner ..... F01D 5/141 415/191
8,573,945 B2 * 11/2013 Wang ..... F01D 5/141 416/223 A (Continued)

FOREIGN PATENT DOCUMENTS

| | | | |
|---|---|---|---|
| WO | 03/006798 | A1 | 1/2003 |
| WO | 2017/105259 | A1 | 6/2017 |
| WO | 2017/105260 | A1 | 6/2017 |

OTHER PUBLICATIONS

Soni, S., et al., Turbomachine and turbine nozzle therefor, GE Co-Pending Application No. 6765/CHE/2015, filed on Dec. 18, 2015.

(Continued)

*Primary Examiner* — David E Sosnowski
*Assistant Examiner* — Sabbir Hasan
(74) *Attorney, Agent, or Firm* — Charlotte C. Wilson; James W. Pemrick

(57) ABSTRACT

A nozzle has an airfoil, and the nozzle is configured for use with a turbomachine. The airfoil has a throat distribution measured at a narrowest region in a pathway between adjacent nozzles, at which adjacent nozzles extend across the pathway between opposing walls to aerodynamically interact with a fluid flow. The airfoil defines the throat distribution, and the throat distribution reduces aerodynamic loss and improves aerodynamic loading on the airfoil. A trailing edge of the airfoil deviates from an axial plane by about 0.1 degrees to about 5 degrees. A turbomachine comprising a plurality of nozzles is also provided.

18 Claims, 7 Drawing Sheets

(56) References Cited

U.S. PATENT DOCUMENTS

| | | | | |
|---|---|---|---|---|
| 9,957,804 | B2 | 5/2018 | Chouhan et al. | |
| 9,957,805 | B2 | 5/2018 | Soni et al. | |
| 9,963,985 | B2 | 5/2018 | Chouhan et al. | |
| 2013/0104550 | A1 | 5/2013 | Smith et al. | |
| 2013/0104566 | A1* | 5/2013 | Stein | F01D 5/141 60/805 |
| 2013/0115075 | A1 | 5/2013 | Gustafson et al. | |

OTHER PUBLICATIONS

International Search Report and Written Opinion issued in connection with corresponding PCT Application No. PCT/PL2015/050069 dated Aug. 18, 2016.

International Preliminary Report on Patentability issued in connection with corresponding PCT Application No. PCT/PL2015/050069 dated Jun. 19, 2018.

* cited by examiner

TURBOMACHINE AND TURBINE NOZZLE THEREFOR

BACKGROUND OF THE INVENTION

The subject matter disclosed herein relates to turbomachines, and more particularly to, a blade in a turbine.

A turbomachine, such as a gas turbine, may include a compressor, a combustor, and a turbine. Air is compressed in the compressor. The compressed air is fed into the combustor. The combustor combines fuel with the compressed air, and then ignites the gas/fuel mixture. The high temperature and high energy exhaust fluids are then fed to the turbine, where the energy of the fluids is converted to mechanical energy. The turbine includes a plurality of nozzle stages and blade stages. The nozzles are stationary components, and the blades rotate about a rotor.

BRIEF DESCRIPTION OF THE INVENTION

Certain embodiments commensurate in scope with the originally claimed subject matter are summarized below. These embodiments are not intended to limit the scope of the claimed subject matter, but rather these embodiments are intended only to provide a brief summary of possible forms of the claimed subject matter. Indeed, the claimed subject matter may encompass a variety of forms that may be similar to or different from the aspects/embodiments set forth below.

In an aspect, a nozzle has an airfoil, and the nozzle is configured for use with a turbomachine. The airfoil has a throat distribution measured at a narrowest region in a pathway between adjacent nozzles, at which adjacent nozzles extend across the pathway between opposing walls to aerodynamically interact with a fluid flow. The airfoil defines the throat distribution, and the throat distribution reduces aerodynamic loss and improves aerodynamic loading on the airfoil. A trailing edge of the airfoil deviates from an axial plane by about 0.1 degrees to about 5 degrees.

In another aspect, a nozzle has an airfoil, and the nozzle is configured for use with a turbomachine. The airfoil has a throat distribution measured at a narrowest region in a pathway between adjacent nozzles, at which adjacent nozzles extend across the pathway between opposing walls to aerodynamically interact with a fluid flow. The airfoil defines the throat distribution, and the throat distribution is defined by values set forth in Table 1 within a tolerance of +/−10%. The throat distribution reduces aerodynamic loss and improves aerodynamic loading on the airfoil. A trailing edge of the airfoil deviates from an axial plane by about 0.1 degrees to about 5 degrees, or by about 1.6 degrees to about 2.0 degrees, or by about 1.8 degrees. The throat distribution may be defined by the values set forth in Table 1. The throat distribution, as defined by a trailing edge of the airfoil, may extend curvilinearly from a throat/throat mid-span value of about 78% at about 0% span to a throat/throat mid-span value of about 100% at about 53% span, and to a throat/throat mid-span value of about 128% at about 100% span. The span at 0% is at a radially inner portion of the airfoil and a span at 100% is at a radially outer portion of the airfoil. The airfoil may have a thickness distribution (Tmax/Tmax_Midspan) as defined by values set forth in Table 2. The airfoil may have a non-dimensional thickness divided by axial chord distribution as defined by values set forth in Table 3. The airfoil may have a non-dimensional axial chord divided by axial chord at mid-span distribution as defined by values set forth in Table 4.

In yet another aspect, a turbomachine includes a plurality of nozzles, and each nozzle has an airfoil. The turbomachine has opposing walls defining a pathway into which a fluid flow is receivable to flow through the pathway. A throat distribution is measured at a narrowest region in the pathway between adjacent nozzles, at which adjacent nozzles extend across the pathway between the opposing walls to aerodynamically interact with the fluid flow. The airfoil defines the throat distribution. The throat distribution is defined by values set forth in Table 1 within a tolerance of +/−10%. The throat distribution reduces aerodynamic loss and improves aerodynamic loading on the airfoil. A trailing edge of the airfoil deviates from an axial plane by about 0.1 degrees to about 5 degrees, or by about 1.6 degrees to about 2.0 degrees, or by about 1.8 degrees.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," and "the" are intended to mean that there are one or more of the elements. The terms "comprising," "including," and "having" are intended to be inclusive and mean that there may be additional elements other than the listed elements.

Figure 1:
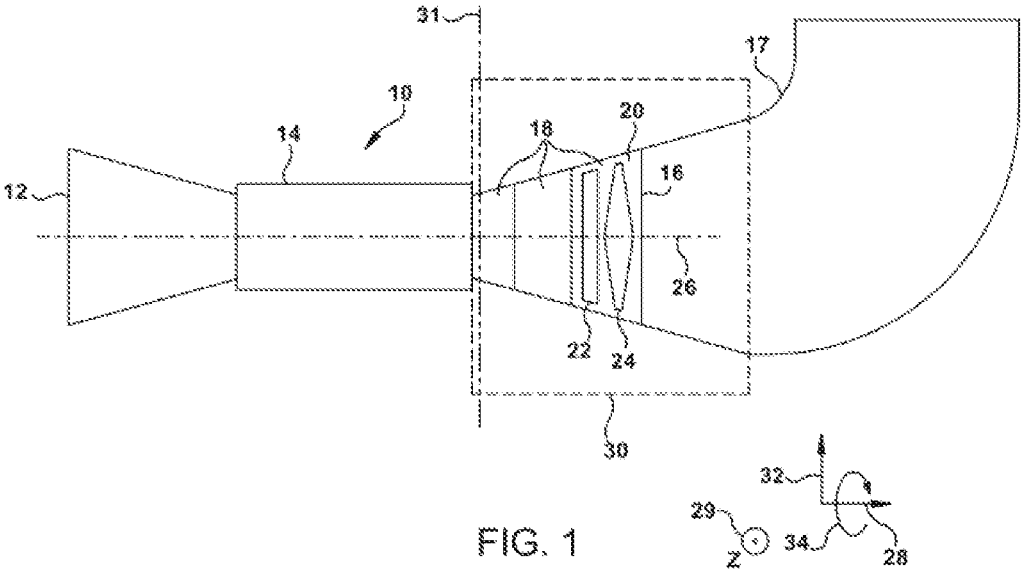
FIG. 1 is a diagram of a turbomachine in accordance with aspects of the present disclosure.

FIG. 1 is a diagram of one embodiment of a turbomachine 10 (e.g., a gas turbine and/or a compressor). The turbomachine 10 shown in FIG. 1 includes a compressor 12, a combustor 14, a turbine 16, and a diffuser 17. Air, or some other gas, is compressed in the compressor 12, fed into the combustor 14 and mixed with fuel, and then combusted. The exhaust fluids are fed to the turbine 16 where the energy from the exhaust fluids is converted to mechanical energy. The turbine 16 includes a plurality of stages 18, including an individual stage 20. Each stage 18, includes a rotor (i.e., a rotating shaft) with an annular array of axially aligned blades, which rotates about a rotational axis 26, and a stator with an annular array of nozzles. Accordingly, the stage 20 may include a nozzle stage 22 and a blade stage 24. For clarity, FIG. 1 includes a coordinate system including an axial (X) axis 28, a Y axis 32, a Z axis 29 and a circumferential direction 34 (which exists in the Y-Z plane, or the circumferential plane or rotational plane 31). Additionally, an axial (or X-Z) plane 30 is shown. The axial plane 30 extends in the axial direction 28 (along the rotational axis 26) in one direction, and then extends outward in the radial or Y-axis direction 32. The X, Y and Z axis are all perpendicular to each other. The X-axis 28 is fixed, as it is tied to the machine orientation and to the installed position of the blades and nozzles. The Z-axis 29 and Y-axis 32 will vary, as the Z-axis is the radial direction and this changes with each blade or nozzle. The Y-axis is always perpendicular to the Z-axis, and the Y-axis will change as it follows the Z-axis. As one example, if the X-axis is the rotational axis of a clock (i.e., the very center), the Z-axis is the 12 o'clock-6 o'clock direction and the Y-axis is the 9 o'clock-3 o'clock direction. If the Z-axis changed to the 1 o'clock-7 o'clock direction, then the Y-axis would change to the 10 o'clock-4 o'clock direction.

Figure 2:
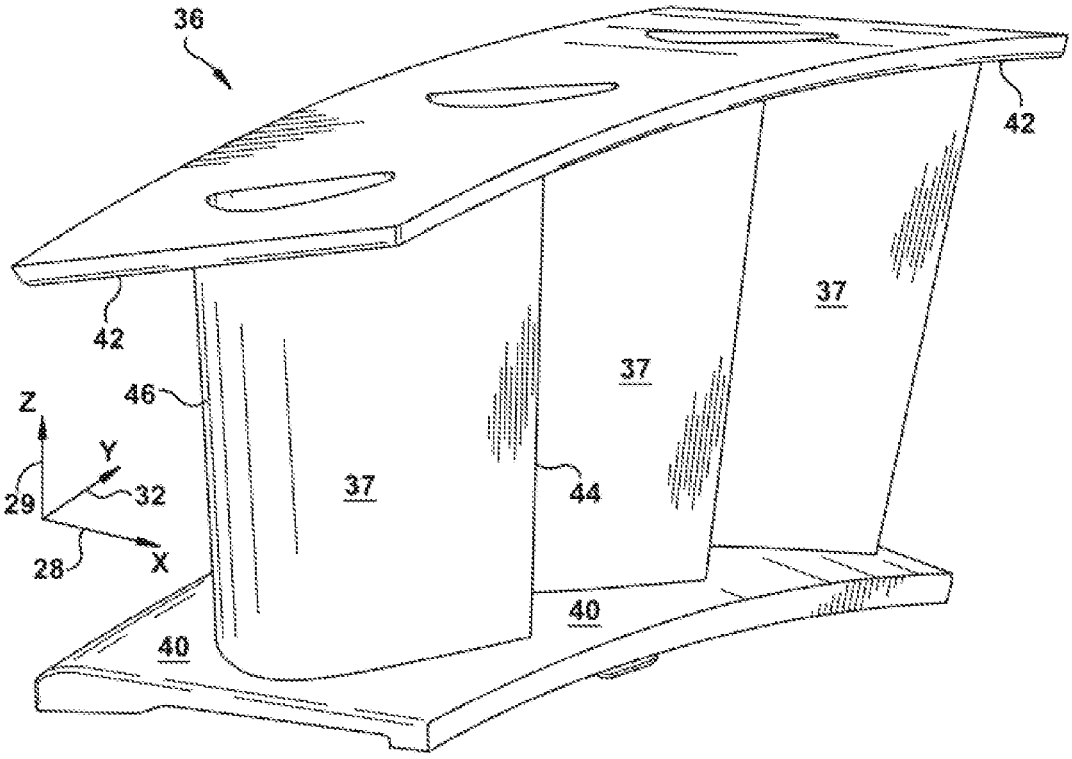
FIG. 2 illustrates a perspective view of a nozzle in accordance with aspects of the present disclosure.

FIG. 2 is a perspective view of a nozzle 36. The nozzles 36 in the stage 20 extend in a radial direction 29 between a first wall (or platform) 40 and a second wall 42 (such as a tip shroud). First wall 40 is opposed to second wall 42, and both walls define a pathway into which a fluid flow is receivable. The nozzles 36 are disposed circumferentially 34 about a hub. Each nozzle 36 has an airfoil 37, and the airfoil 37 is configured to aerodynamically interact with the exhaust fluids from the combustor 14 as the exhaust fluids flow generally downstream through the turbine 16 in the axial direction 28. As illustrated, fluid flow actually flows in the negative X direction in FIG. 2. Each nozzle 36 has a leading edge 44, a trailing edge 46 disposed downstream in the axial direction 28 of the leading edge 44, a pressure side 48, and a suction side 50. The pressure side 48 extends in the axial direction 28 between the leading edge 44 and the trailing edge 46, and in the radial direction 32 between the first wall 40 and the second wall 42. The suction side 50 extends in the axial direction 28 between the leading edge 44 and the trailing edge 46, and in the radial direction 29 between the first wall 40 and the second wall 42, opposite the pressure side 48. The nozzles 36 in the stage 20 are configured such that the pressure side 48 of one nozzle 36 faces the suction side 50 of an adjacent nozzle 36. As the exhaust fluids flow toward and through the passage between nozzles 36, the exhaust fluids aerodynamically interact with the nozzles 36 such that the exhaust fluids flow with an angular momentum and direction relative to the axial direction 28. A nozzle stage 22 populated with nozzles 36 having a specific throat distribution configured to exhibit reduced aerodynamic loss and improved aerodynamic loading may result in improved machine efficiency and part longevity.

Figure 3:
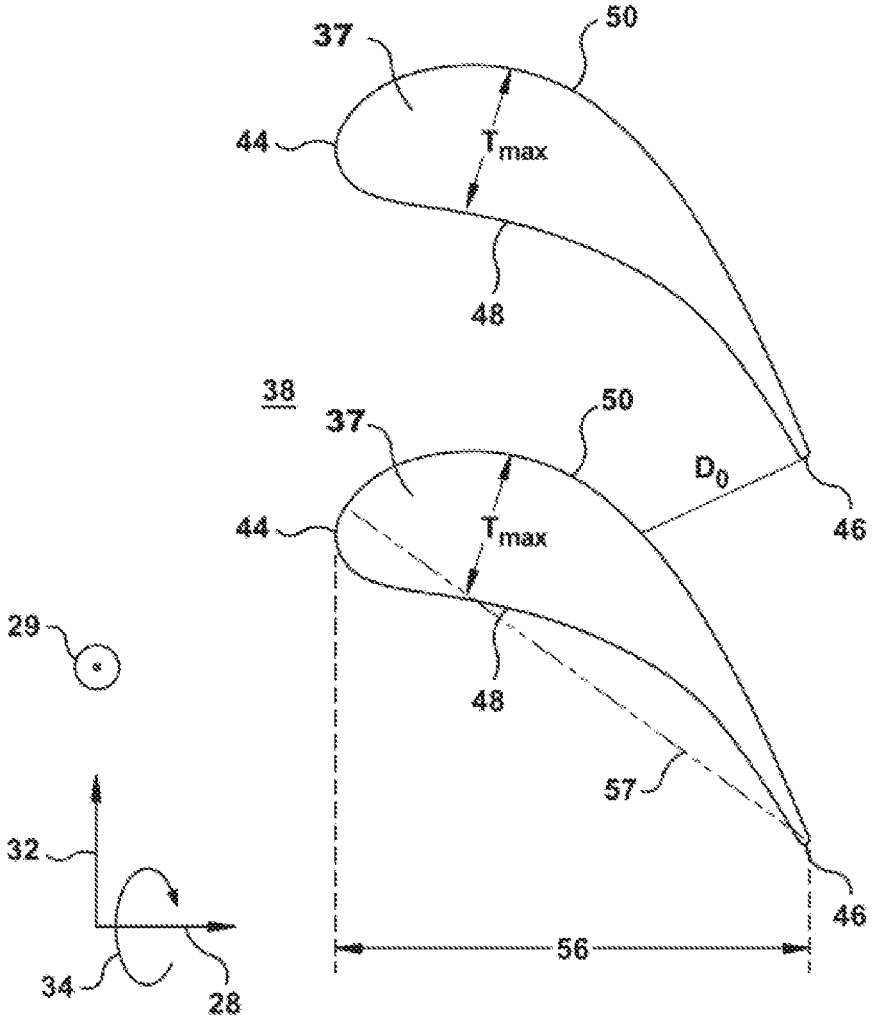
FIG. 3 is a top view of two adjacent nozzles in accordance with aspects of the present disclosure.

FIG. 3 is a top view of two adjacent nozzles 36. Note that the suction side 50 of the bottom nozzle 36 faces the pressure side 48 of the top nozzle 36. The axial chord 56 is the dimension of the blade 36 in the axial direction 28. The chord 57 is the distance between the leading edge and trailing edge of the airfoil. The passage 38 between two adjacent nozzles 36 of a stage 18 defines a throat distribution $D_o$, measured at the narrowest region of the passage 38 between adjacent nozzles 36. Fluid flows through the passage 38 in the axial direction 28. This throat distribution $D_o$ across the span from the first wall 40 to the second wall 42 will be discussed in more detail in regard to FIG. 4. The maximum thickness of each nozzle 36 at a given percent span is shown as Tmax.

Figure 4:
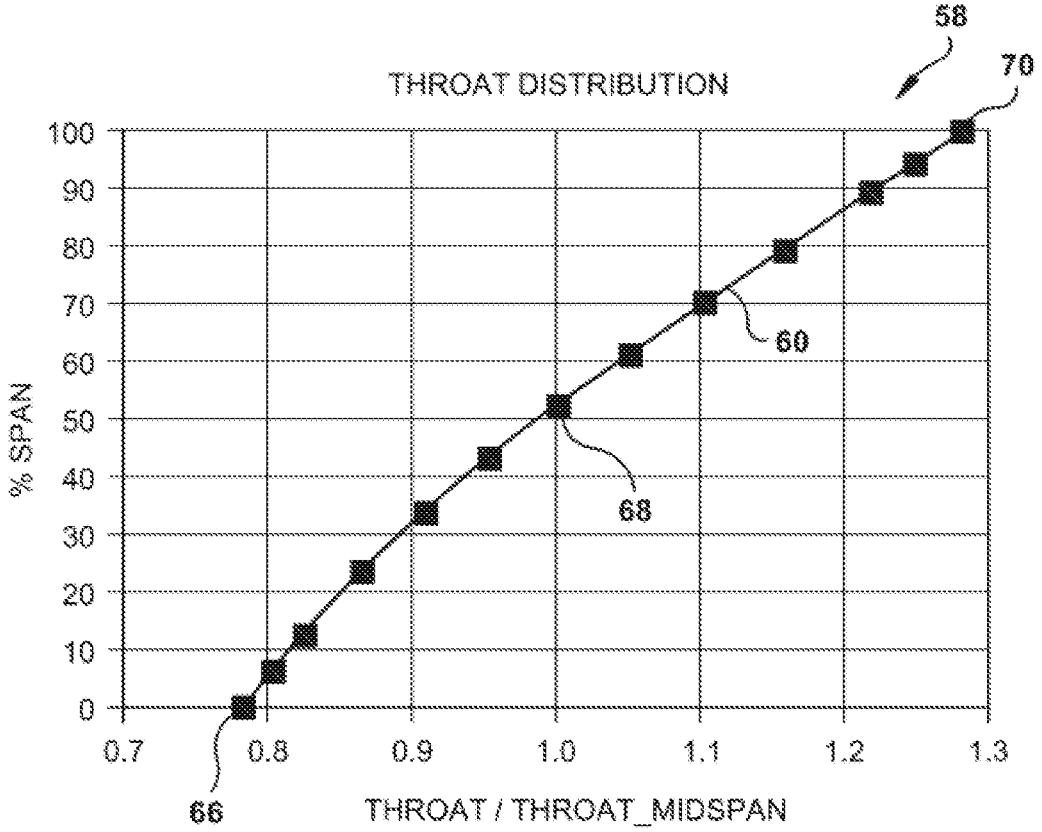
FIG. 4 is a plot of a throat distribution in accordance with aspects of the present disclosure.

FIG. 4 is a plot of throat distribution $D_o$ defined by adjacent nozzles 36 and shown as curve 60. The vertical axis represents the percent span between the first annular wall 40 and the second annular wall 42 or opposing end of airfoil 37 in the radial direction 29. That is, 0% span generally represents the first annular wall 40 and 100% span represents the opposing end of airfoil 37, and any point between 0% and 100% corresponds to a percent distance between the radially inner and radially outer portions of airfoil 37, in the radial direction 29 along the height of the airfoil. The horizontal axis represents $D_o$ (Throat), the shortest distance between two adjacent nozzles 36 at a given percent span, divided by the $D_{o_MidSpan}$ (Throat_MidSpan), which is the $D_o$ at about 50% to about 60% span. Dividing $D_o$ by the $D_{o_Midspan}$ makes the plot 58 non-dimensional, so the curve 60 remains the same as the nozzle stage 22 is scaled up or down for different applications. One could make a similar plot for a single size of turbine in which the horizontal axis is just $D_o$.

As can be seen in FIG. 4, the throat distribution, as defined by a trailing edge of the blade, extends curvilinearly from a throat/throat_mid-span value of about 78% at about 0% span (point 66) to a throat/throat_mid-span value of about 128% at about 100% span (point 70). The span at 0% is at a radially inner portion of the airfoil and the span at 100% is at a radially outer portion of the airfoil. The throat/throat mid-span value is 100% at about 50% to 55% span (point 68). The throat distribution shown in FIG. 4 may help to improve performance in two ways. First, the throat distribution helps to produce desirable exit flow profiles. Second, the throat distribution shown in FIG. 4 may help to manipulate secondary flows (e.g., flows transverse to the main flow direction) and/or purge flows near the first annular wall 40 (e.g., the hub). Table 1 lists the throat distribution and various values for the trailing edge shape of the airfoil 37 along multiple span locations. FIG. 4 is a graphical illustration of the throat distribution. It is to be understood that the values in Table 1 may have a tolerance of +/−10%.

TABLE 1

| % Span | Throat/Throat_MidSpan |
|---|---|
| 100 | 1.280 |
| 95 | 1.248 |
| 89 | 1.216 |
| 80 | 1.157 |
| 70 | 1.102 |
| 61 | 1.050 |
| 53 | 1.000 |
| 43 | 0.952 |
| 34 | 0.908 |

TABLE 1-continued

| % Span | Throat/Throat_MidSpan |
|---|---|
| 24 | 0.865 |
| 13 | 0.824 |
| 6 | 0.803 |
| 0 | 0.783 |

Figure 5:
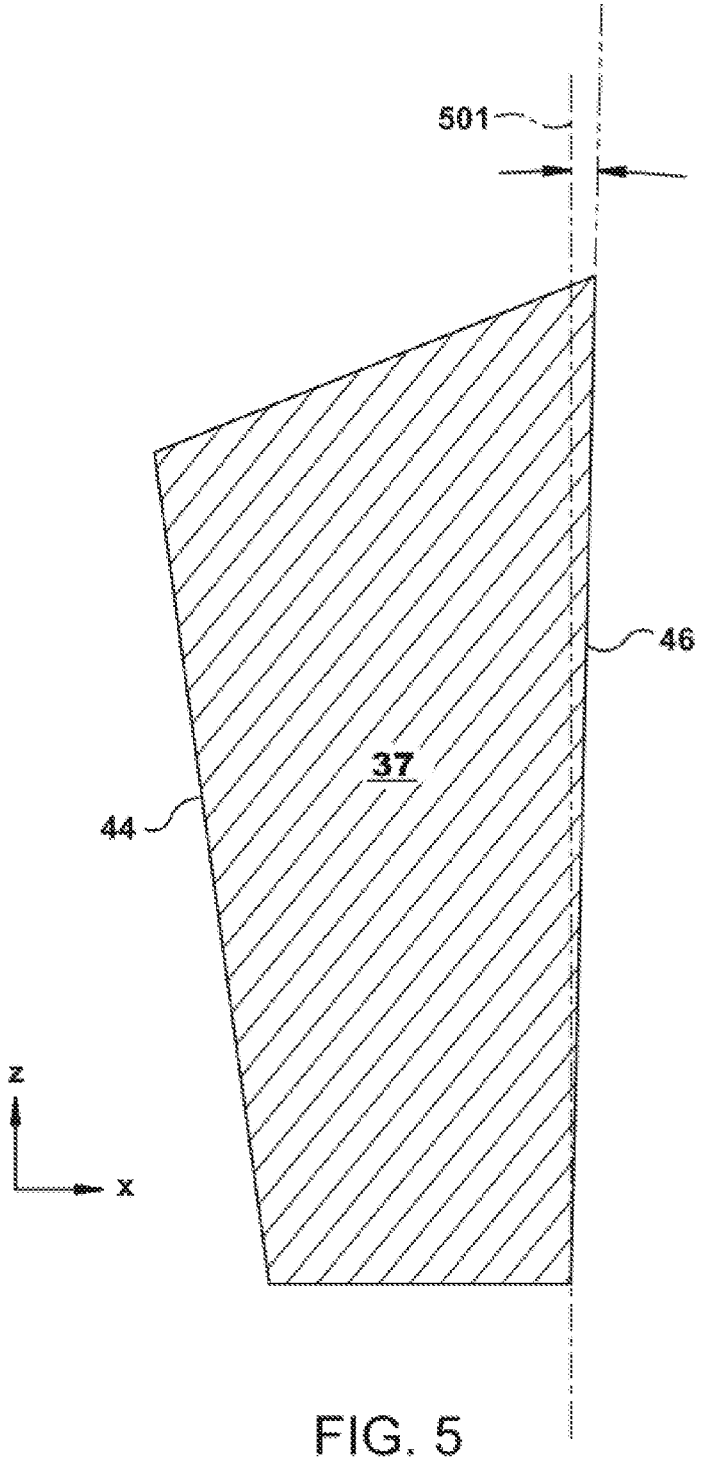
FIG. 5 illustrates a side view of the airfoil in the X-Z plane, where Z is the span or radial direction, in accordance with aspects of the present disclosure.

FIG. 5 illustrates a side view of the airfoil in the X-Z or axial plane, where Z is the span or radial direction. The trailing edge 46 of the airfoil 37 deviates from the axial plane 501 as the span increases. The axial plane 501 intersects the trailing edge at 0% span. The trailing edge 46 of the airfoil deviates from the axial plane 501 by about 0.1 degrees to about 5 degrees, or by about 1.6 degrees to about 2.0 degrees, or by about 1.8 degrees. The trailing edge deviation occurs in the +X or downstream direction. Additionally, a nozzle 36 or airfoil 37 with a trailing edge deviation as indicated in FIG. 5 may help to improve flow aerodynamics and therefore improve efficiency of nozzle 36 and the downstream blade.

Figure 6:
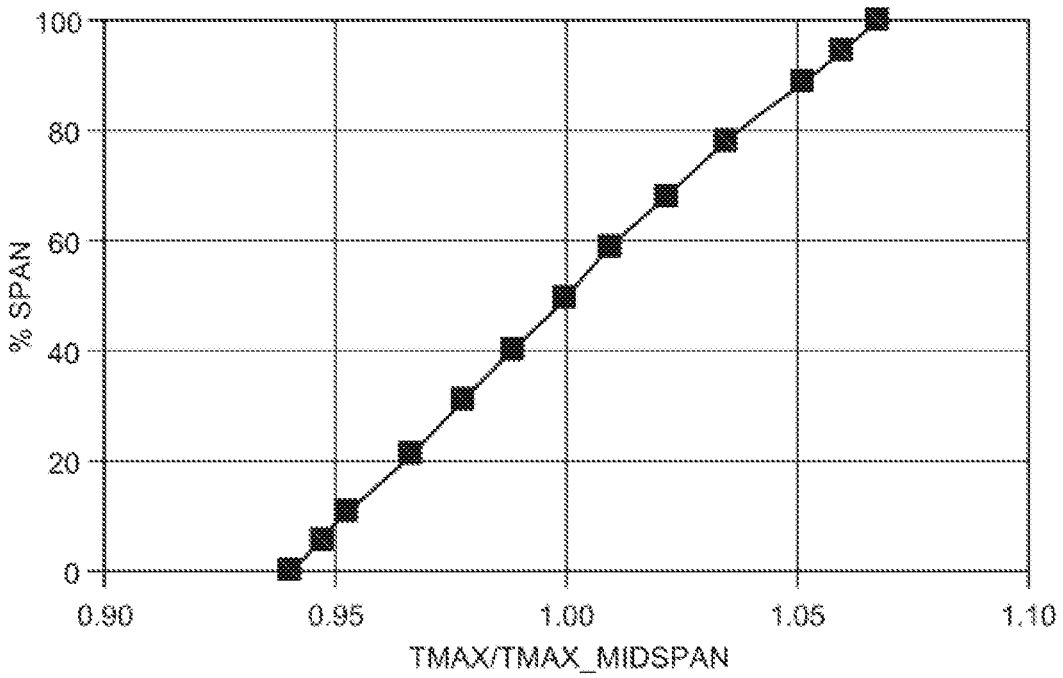
FIG. 6 is a plot of non-dimensional maximum thickness distribution in accordance with aspects of the present disclosure.

FIG. 6 is a plot of the thickness distribution Tmax/Tmax_Midspan, as defined by a thickness of the nozzle's airfoil 37. The vertical axis represents the percent span between the first annular wall 40 and opposing end of airfoil 37 in the radial direction 29. The horizontal axis represents the Tmax divided by Tmax_Midspan value. Tmax is the maximum thickness of the airfoil at a given span, and Tmax_Midspan is the maximum thickness of the airfoil at mid-span (e.g., about 49% to 54% span). Dividing Tmax by Tmax_Midspan makes the plot non-dimensional, so the curve remains the same as the nozzle stage 22 is scaled up or down for different applications. Referring to Table 2, a mid-span value of about 50% has a Tmax/Tmax_Midspan value of 1, because at this span Tmax is equal to Tmax_Midspan.

TABLE 2

| % Span | Tmax/Tmax_MidSpan |
|---|---|
| 100 | 1.07 |
| 94.12 | 1.06 |
| 88.48 | 1.05 |
| 77.85 | 1.03 |
| 68.00 | 1.02 |
| 58.75 | 1.01 |
| 49.55 | 1.00 |
| 40.36 | 0.99 |
| 31.10 | 0.98 |
| 21.35 | 0.97 |
| 11.00 | 0.95 |
| 5.58 | 0.95 |
| 0 | 0.94 |

Figure 7:
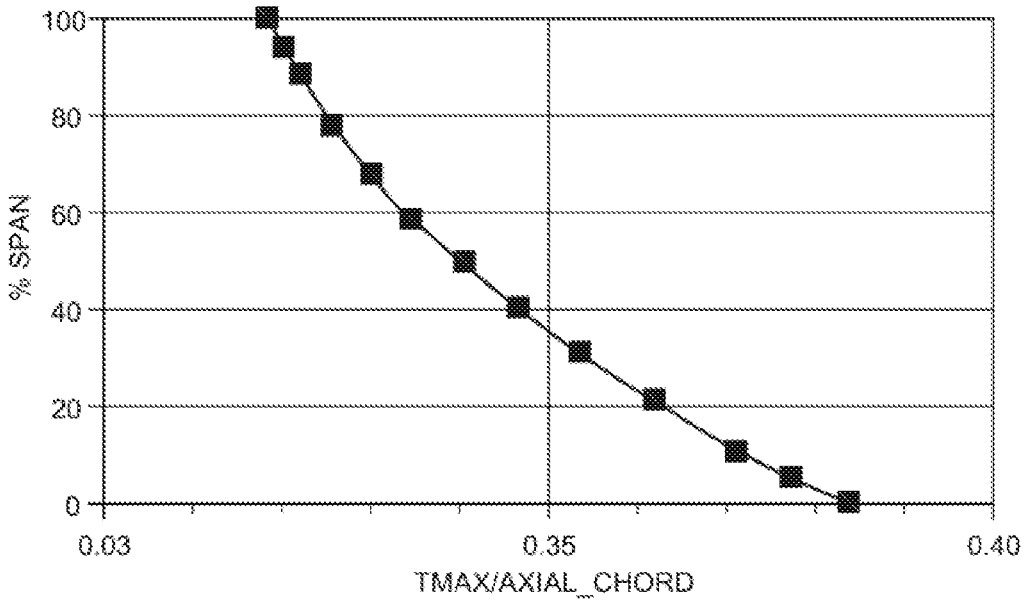
FIG. 7 is a plot of maximum thickness divided by axial chord distribution in accordance with aspects of the present disclosure.

FIG. 7 is a plot of the airfoil thickness (Tmax) divided by the airfoil's axial chord along various values of span. The vertical axis represents the percent span between the first amnular wall 40 and opposing end of airfoil 37 in the radial direction 29. The horizontal axis represents the Tmax divided by axial chord value. Dividing the airfoil thickness by the axial chord makes the plot non-dimensional, so the curve remains the same as the blade stage 24 is scaled up or down for different applications. A nozzle design with the Tmax distribution shown in FIGS. 6 and 7 may help to tune the resonant frequency of the nozzle in order to avoid crossings with drivers. Accordingly, a nozzle 36 design with the Tmax distribution shown in FIGS. 6 and 7 may increase the operational lifespan of the nozzle 36. Table 3 lists the Tmax/Axial Chord value for various span values.

TABLE 3

| % Span | Tmax/Chord |
|---|---|
| 100 | 0.318 |
| 94.12 | 0.320 |
| 88.48 | 0.322 |
| 77.85 | 0.326 |
| 68.00 | 0.330 |
| 58.75 | 0.335 |
| 49.55 | 0.341 |
| 40.36 | 0.347 |
| 31.10 | 0.354 |
| 21.35 | 0.362 |
| 11.00 | 0.371 |
| 5.58 | 0.377 |
| 0 | 0.384 |

Figure 8:
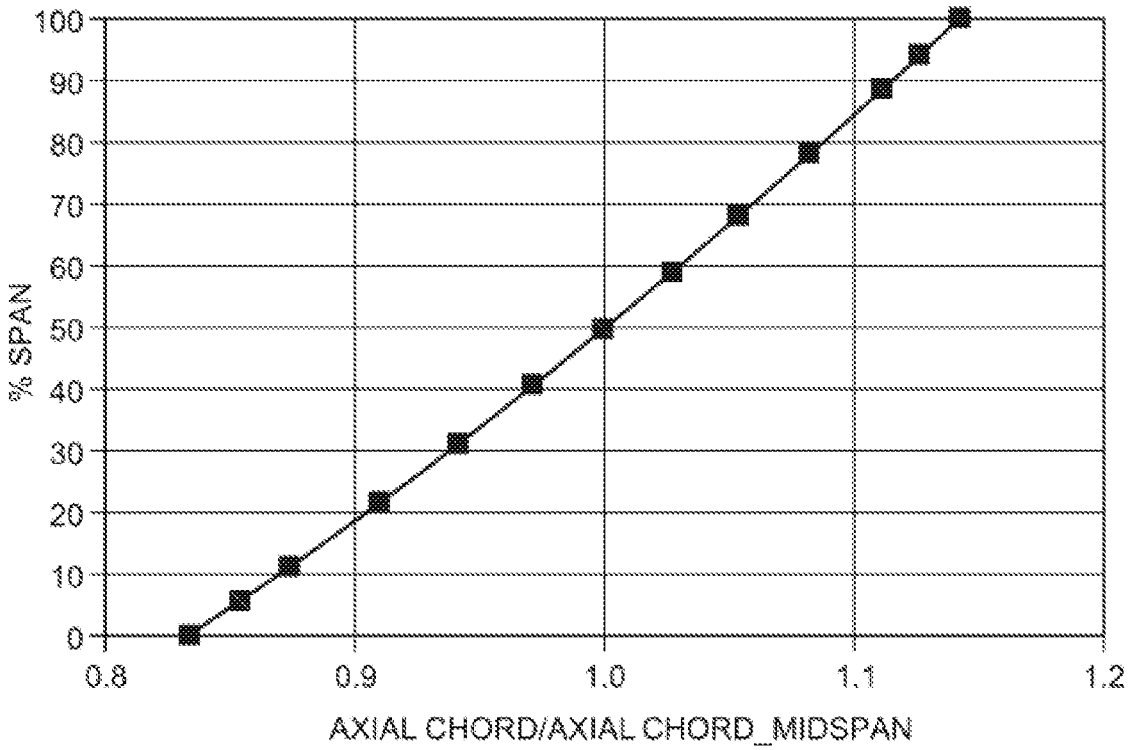
FIG. 8 is a plot of axial chord divided by axial chord at mid-span in accordance with aspects of the present disclosure.

FIG. 8 is a plot of the airfoil's axial chord divided by the axial chord value at mid-span along various values of span. The vertical axis represents the percent span between the first annular wall 40 and opposing end of airfoil 37 in the radial direction 29. The horizontal axis represents the axial chord divided by axial chord at mid-span value. Referring to Table 4, a mid-span value of about 50% has a Axial Chord/Axial Chord_MidSpan value of 1, because at this span axial chord is equal to axial chord at the mid-span location. Dividing the axial chord by the axial chord at mid-span makes the plot non-dimensional, so the curve remains the same as the nozzle stage 22 is scaled up or down for different applications. Table 4 lists the values for the airfoil's axial chord divided by the axial chord value at mid-span along various values of span.

TABLE 4

| % Span | Axial Chord/Axial Chord_MidSpan |
|---|---|
| 100 | 1.143 |
| 94.12 | 1.127 |
| 88.48 | 1.112 |
| 77.85 | 1.082 |
| 68.00 | 1.054 |
| 58.75 | 1.028 |
| 49.55 | 1.000 |
| 40.36 | 0.972 |
| 31.10 | 0.942 |
| 21.35 | 0.910 |
| 11.00 | 0.874 |
| 5.58 | 0.855 |
| 0 | 0.834 |

A nozzle design with the axial chord distribution shown in FIG. 8 may help to tune the resonant frequency of the airfoil in order to avoid crossings with drivers. For example, a nozzle with a linear design may have a resonant frequency of 400 Hz, whereas the nozzle 36 with an increased thickness around certain spans may have a resonant frequency of 450 Hz. If the resonant frequency of the airfoil is not carefully tuned to avoid crosses with the drivers, operation may result in undue stress on the nozzle 36 and possible structural failure. Accordingly, a nozzle 36 design with the axial chord distribution shown in FIG. 8 may increase the operational lifespan of the nozzle 36.

Technical effects of the disclosed embodiments include improvement to the performance of the turbine in a number of different ways. The nozzle 36 design and the throat distribution shown in FIG. 4 may help to manipulate secondary flows (i.e., flows transverse to the main flow direction) and/or purge flows near the hub (e.g., the first annular wall 40). A nozzle or airfoil with a spanwise thickness and chord distribution as described above may help to tune the resonant frequency of the airfoil in order to avoid crossings with drivers. If the resonant frequency of the nozzle is not carefully tuned to avoid crosses with the drivers, operation may result in undue stress on the nozzle 36 and possible structural failure. Accordingly, a nozzle 36 design with the increased thickness at specific span locations may increase the operational lifespan of the nozzle 36.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A nozzle having an airfoil, the nozzle configured for use with a turbomachine, the airfoil comprising:

a throat distribution defined by values set forth in Table 1 within a tolerance of +/−10%, the throat distribution being measured at a narrowest region in a pathway between adjacent nozzles, at which adjacent nozzles extend across the pathway between opposing walls to aerodynamically interact with a fluid flow; and the airfoil defining the throat distribution, the throat distribution reducing aerodynamic loss and improving aerodynamic loading on the airfoil, and a trailing edge of the airfoil deviating from an axial plane by 0.1 degrees to 5 degrees.

2. The nozzle of claim 1, wherein the trailing edge of the airfoil deviates from the axial plane by 1.6 degrees to 2.0 degrees.

3. The nozzle of claim 1, wherein the trailing edge of the airfoil deviates from the axial plane by 1.8 degrees.

4. The nozzle of claim 1, wherein the throat distribution, as defined by a trailing edge of the airfoil, extends curvilinearly from a throat/throat mid-span value of 78% at 0% span to a throat/throat mid-span value of 100% at 53% span, and to a throat/throat mid-span value of 128% at 100% span; and wherein the span at 0% is at a radially inner portion of the airfoil and a span at 100% is at a radially outer portion of the airfoil.

5. The nozzle of claim 1, wherein the airfoil has a thickness distribution (Tmax/Tmax_Midspan) as defined by values set forth in Table 2.

6. The nozzle of claim 5, wherein the airfoil has a non-dimensional thickness distribution as defined by values set forth in Table 3.

7. The nozzle of claim 6, wherein the airfoil has a non-dimensional axial chord distribution as defined by values set forth in Table 4.

8. A nozzle having an airfoil, the nozzle configured for use with a turbomachine, the airfoil comprising:

a throat distribution measured at a narrowest region in a pathway between adjacent nozzles, at which adjacent nozzles extend across the pathway between opposing walls to aerodynamically interact with a fluid flow; and the airfoil defining the throat distribution, the throat distribution defined by values set forth in Table 1 within a tolerance of +/−10%, the throat distribution reducing aerodynamic loss and improving aerodynamic loading on the airfoil, and a trailing edge of the airfoil deviating from an axial plane by 1.6 degrees to 2.0 degrees.

9. The nozzle of claim 8, wherein the throat distribution, as defined by a trailing edge of the airfoil, extends curvilinearly from a throat/throat mid-span value of 78% at 0% span to a throat/throat mid-span value of 100% at 53% span, and to a throat/throat mid-span value of 128% at 100% span; and wherein the span at 0% is at a radially inner portion of the airfoil and a span at 100% is at a radially outer portion of the airfoil.

10. The nozzle of claim 8, wherein the airfoil has a thickness distribution (Tmax/Tmax_Midspan) as defined by values set forth in Table 2.

11. The nozzle of claim 8, wherein the airfoil has a non-dimensional thickness distribution as defined by values set forth in Table 3.

12. The nozzle of claim 8, wherein the airfoil has a non-dimensional axial chord distribution as defined by values set forth in Table 4.

13. A turbomachine comprising a plurality of nozzles, each nozzle comprising an airfoil, the turbomachine comprising:

opposing walls defining a pathway into which a fluid flow is receivable to flow through the pathway, a throat distribution is measured at a narrowest region in the pathway between adjacent nozzles, at which adjacent nozzles extend across the pathway between the opposing walls to aerodynamically interact with the fluid flow; and the airfoil defining the throat distribution, the throat distribution defined by values set forth in Table 1 within a tolerance of +/−10%, the throat distribution reducing aerodynamic loss and improving aerodynamic loading on the airfoil, and a trailing edge of the airfoil deviating from an axial plane by 0.1 degrees to 5 degrees.

14. The turbomachine of claim 13, wherein the trailing edge of the airfoil deviates from an axial plane by 1.6 degrees to 2.0 degrees.

15. The turbomachine of claim 13, wherein the trailing edge of the airfoil deviates from an axial plane by 1.8 degrees.

16. The turbomachine of claim 13, wherein the airfoil has a thickness distribution (Tmax/Tmax_Midspan) as defined by values set forth in Table 2.

17. The turbomachine of claim 13, wherein the airfoil has a non-dimensional thickness distribution according to values set forth in Table 3.

18. The turbomachine of claim 13, wherein the airfoil has a non-dimensional axial chord distribution according to values set forth in Table 4.

* * * * *